US010427906B2

(12) United States Patent
McGonagle et al.

(10) Patent No.: US 10,427,906 B2
(45) Date of Patent: Oct. 1, 2019

(54) MODULAR SECTIONS FOR TEMPORARY TURNTABLE APPLICATIONS

(71) Applicant: BBM Railway Equipment, LLC, Youngstown, OH (US)

(72) Inventors: Peter McGonagle, Southport, CT (US); Stephen Schumacher, Sandy Hook, CT (US)

(73) Assignee: BBM Railway Equipment, LLC, Youngstown, OH (US)

( * ) Notice: Subject to any disclaimer, the term of this patent is extended or adjusted under 35 U.S.C. 154(b) by 23 days.

(21) Appl. No.: 15/337,433

(22) Filed: Oct. 28, 2016

(65) Prior Publication Data

US 2017/0121146 A1 May 4, 2017

Related U.S. Application Data

(60) Provisional application No. 62/247,961, filed on Oct. 29, 2015.

(51) Int. Cl.
*B65H 49/28* (2006.01)
*B65H 75/30* (2006.01)

(52) U.S. Cl.
CPC ..... *B65H 49/28* (2013.01); *B65H 75/30* (2013.01); *B65H 2701/34* (2013.01)

(58) Field of Classification Search
CPC .... B65H 49/28; B65H 75/30; B65H 2701/34; A47B 49/00; A47B 49/008
USPC ..... 242/571, 577; 108/139, 103, 104
See application file for complete search history.

(56) References Cited

U.S. PATENT DOCUMENTS 254,388 A * 2/1882 Schultz ..... A47B 35/00 108/139
481,306 A * 8/1892 Miller et al. ..... B65H 23/06 242/156
748,116 A * 12/1903 Stoll ..... A63J 1/00 108/20
1,401,824 A * 12/1921 Smith ..... A21B 1/10 108/139
1,819,656 A * 8/1931 Pressley ..... A63J 1/00 108/139
1,941,906 A * 1/1934 Marinsky ..... F25D 25/027 108/103
2,113,386 A * 4/1938 Schneider ..... A47B 49/00 108/103
2,335,301 A * 11/1943 Oidtmann ..... G09F 13/00 108/105
2,338,324 A * 1/1944 Floyd ..... A47F 5/025 108/105

(Continued)

FOREIGN PATENT DOCUMENTS

WO 2015011462 A1 1/2015

OTHER PUBLICATIONS

Demanor, "Cable Carousels", retrieved on Aug. 31, 2016, 1 page.

(Continued)

*Primary Examiner* — Michael Safavi
(74) *Attorney, Agent, or Firm* — Fay Sharpe LLP

(57) ABSTRACT

A turntable in modular pie or other sections, which sections can be added or taken away in concentric rings from a base version of the turntable in order to scale the size and capacity of that turntable to accommodate a wide range of size and loading needs.

23 Claims, 9 Drawing Sheets

(56) References Cited

U.S. PATENT DOCUMENTS 2,494,242 A * 1/1950 Hardy ..... A47B 1/04 108/139
3,246,613 A * 4/1966 Johnston ..... A47B 11/00 108/20
3,804,111 A 4/1974 Chatard et al.
3,815,842 A * 6/1974 Scrogin ..... B65H 49/305 242/423.1
3,965,713 A 6/1976 Horton
4,643,104 A * 2/1987 Rasmussen ..... A47F 5/05 108/105
4,647,253 A 3/1987 Jacobson et al.
4,782,764 A * 11/1988 Robinson ..... A47B 7/00 108/104
5,000,513 A * 3/1991 Schmidt ..... A61G 7/1076 108/139
5,167,586 A 12/1992 Morris
5,400,550 A * 3/1995 Beasley ..... E04B 1/346 104/35
6,349,808 B1 2/2002 Bryant
6,386,885 B1 5/2002 Ford
6,516,892 B2 2/2003 Reilly
6,609,773 B1 * 8/2003 Steadman ..... A47B 49/00 108/105
6,672,221 B2 1/2004 Hadley
6,745,699 B2 6/2004 Hill
6,988,854 B2 1/2006 Porter
7,581,904 B2 9/2009 Bursaux et al.
7,665,685 B2 2/2010 Moore, III et al.
8,505,245 B2 * 8/2013 Bobryshev ..... G09B 5/00 108/139
8,727,262 B2 5/2014 Underbrink et al.
8,747,025 B2 6/2014 Anderson et al.
9,200,727 B2 12/2015 Pionetti et al.
2005/0076817 A1 * 4/2005 Boks ..... A47B 49/004 108/103
2007/0278916 A1 12/2007 Cermak et al.
2009/0261210 A1 * 10/2009 Moore, III ..... B65H 49/28 248/49
2014/0145023 A1 5/2014 Satola
2015/0141162 A1 5/2015 Fox

OTHER PUBLICATIONS

The Macton Corporation, Marine Cable Laying Turntables brochure, retrieved Aug. 31, 2016, 2 pages.
Oceanteam Solutions, Portable Modular Turntable—p. 2, image 3. retrieved on Aug. 31, 2016, 11 pages.
Jack Shepard, Macton Corporation, "Turn it Around Fast", Marine Technology Reporter, Jan./Feb. 2012, 5 pages.

* cited by examiner

MODULAR SECTIONS FOR TEMPORARY TURNTABLE APPLICATIONS

FIELD OF THE INVENTION

The present invention relates to a turntable. More specifically, the invention relates to a modular turntable for temporary customer uses (such as turntables temporarily affixed to the deck of a ship that are used for the laying of underwater cables), that can be increased or reduced in size to fit the customer's needs on a particular project.

BACKGROUND OF THE INVENTION

Prior art turntables are generally fixed in size for a particular application, so they are specifically designed and manufactured for just one set of customer needs (i.e., built to a specific turntable diameter and with one or more specific loading capacities). For instance, when underwater power or signal cables need to be laid underwater for the transmission of electric power or communications signals from one ocean or lake coast to another, it is often done by the mounting of turntables that contain such cables onto the deck of a ship or barge and then as the ship or barge leaves one coast it lays out those cables that are unspooled from the turntable. Once the cable has been laid underwater for that particular project, the turntable often has no other uses unless there is another project that requires a turntable having a similar diameter and loading capacity, which is not very often, resulting typically in the immediate obsolescence of that turntable.

Another common temporary turntable application is where a temporary turntable is required for a construction jobsite to allow for the turning of construction vehicles (such as dump trucks, concrete trucks and other similar vehicles) in portions of the construction site that have constrained space and where it is difficult for the vehicles to turn around; in such situations, a general contractor may want to install a temporary turntable in those areas of the construction site that temporarily have such constrained spaces.

For customers needing to purchase a turntable for one of these projects, the turntable can be very expensive (since it is often large and made out of steel to accommodate very large loads) and its cost cannot be easily spread out amongst other projects and other customer uses if those other projects and customer uses require different turntable sizes or load capacities. For some customers, they have attempted to address this problem by having an existing turntable be modified after its initial use to accommodate another project by hiring one or more other firms to develop a design for the different sizes and load capacities needed and then to manufacture and ship the parts needed for such modifications, and to extensively cut up and modify the existing turntable for such modifications (which can be very expensive and time-consuming). In some cases, the modified turntable may not work as well as a turntable that was designed and built from scratch, since the modifications may require extensive cutting, drilling, welding, grinding and fit-up work be done between new and old parts that may not mate up well with one another.

SUMMARY OF THE INVENTION

One object of the invention is to provide a turntable that can be modified in size/capacity in an easy and cost-efficient manner to fit the particular changing needs of a customer from project to project. It is therefore desirable to have a turntable designed from the start to accommodate a wide range of diameters and loading capacities that can be easily adjusted as the customer's needs change.

It is also desirable to have the turntable be broken down into different sections that can be easily shipped from one customer jobsite to another customer jobsite as the customer's needs change. It is further desirable to have these sections easily mate up with one another so that the size and loading capacity can be scaled up or down easily and quickly.

These and other objects are achieved by providing a turntable in modular pie or other sections, which sections can be added or taken away from a base version of the turntable in order to scale the size and capacity of that turntable to accommodate a wide range of customer needs. For instance, the turntable might have a center section and three outer concentric rings of pie sections that surround the center section, and then (i) if the turntable diameter later needs to be adjusted to a smaller diameter, one or more of the outer rings of sections can be temporarily removed and stored, or (ii) if the turntable diameter later needs to be adjusted to a larger diameter, one or more outer rings of sections that were in storage can be taken out of storage and temporarily added on to the existing turntable structure. Similarly, if the turntable were to need a higher or lower level of loading capacity, the modular sections that get added or removed from the turntable can be replaced with modular sections with more or less structural strength (such as with an increased or decreased amount of steel supports contained within such section for a section needing additional or less loading capacity, as the case may be). In addition, such modular sections can be designed and built with hole patterns that allow for the easy bolting up of such sections to the corresponding modular sections to which they are to be attached (or through other removable attachment mechanisms, such as through hooks or others). Further, as the needs of the particular turntable application require, more or less wheel-sets, track sections and drive units may be added or removed from the turntable structure to allow for easy movement of the turntable around its axis of rotation.

In one aspect the turntable includes a hub defining a first rotation axis. A base includes rolling supports that each rotate about a respective axis of rotation perpendicular to the first rotation axis, the base includes multiple base sections. A rotating member is secured to the hub such that a center of the rotating member aligns with the first rotation axis and includes a plurality of sections. A first one of the plurality of base sections is located radially around the hub and includes a first set of the rolling supports. A first one of the sections is coupled to the hub that defines a center of the rotating member. The first one of the sections is supported by the first set of rolling supports and defines a first radius. A second one of the base sections is removably secured radially outwards of the first base section and includes a second set of the rolling supports. A second section is removably secured around the first section and supported at least in part by the second set rollers to define a second radius greater than the first radius.

In some embodiments the first section includes a plurality of pieces that are removably secured to each other to create the first section. In other embodiments the second section includes a plurality of pieces that are removably secured to each other to create the second section.

In yet other embodiments, the first one of the base sections includes parts that are removably secured to each other to create the first one of the base sections. In yet other embodiments the second one of the base sections includes parts removably secured to each other to create the second one of said plurality of base sections.

In other aspects, a turntable comprises a hub defining an axis and a first section having an outer edge and a center aligned with the axis. The first section is affixed to the hub. A second section has an inner edge, the inner edge configured to fit around the outer edge of said first section. The second section is removably secured to the first section such that the first and second sections are rotatable about the hub.

In one embodiment the second section is configured to be arranged concentrically around the first section. In other embodiments, rollers are positioned below a bottom surface of the first and second sections. The rollers support the first and second sections to enable rotation about the hub. In other embodiments a base has the rollers secured thereto. In other embodiments the base is comprised of a plurality of pieces, each including a plurality of rollers secured thereto. In yet other embodiments a first set of the pieces corresponds to the first section and a second set of the plurality of pieces corresponds to the second section. The second set of the pieces is configured as a concentric ring around said first set of plurality of pieces when said first and second sets of said plurality of pieces are assembled. In other embodiments the first set of the pieces has a center which aligns with the axis.

In other aspects a kit is provided for a modular turntable and includes a hub defining an axis of rotation and a plurality of pieces. A first set of the pieces corresponds to a first rotatable section which is configured to have its center aligned with the axis of rotation. A second set of the pieces corresponds to a second rotatable section which is configured to secure to the first rotatable section around an outer edge of the first rotatable section. A third set of the plurality of pieces corresponds to a first base section which is configured to have its center aligned with the axis of rotation. A fourth set of the pieces corresponds to a second base section configured to be positioned radially outwards of the first base section. Rollers are configured to be positioned between the first and second base sections and the first and second rotatable sections such that the first and second rotatable sections are supported by said rollers to enable rotation.

In one embodiment the rollers are coupled to one of the pieces in the third or fourth set of pieces. In another embodiment a motor is configured to drive the first and second rotatable sections to rotate about the axis of rotation. In another embodiment the motor is configured to drive the first and second rotatable sections at an outer edge of the second rotatable section. In other embodiments, the kit includes multiple motors. In other embodiments the motors each include a gearbox.

As used herein, the terms "first" and "second" are used to distinguish one element, set, object or thing from another, and are not used to designate relative position or arrangement in time.

Therefore, in one aspect the turntable includes a hub defining a first rotation axis. A base includes rolling supports that each rotate about one of a plurality of axes of rotation perpendicular to the first rotation axis. The base is made up of a plurality of base sections. A rotating member is secured to the hub such that a center of the rotating member aligns with the first rotation axis. The rotating member includes a plurality of sections. A first one of the base sections is disposed radially around the hub and includes a first set of the plurality of rolling supports. A first one of the plurality of sections is coupled to the hub that defines a center of the rotating member. The first one of the plurality of sections defines a first radius and is supported by the first set of the plurality of rolling supports. A second one of the plurality of base sections is removably secured radially outwards of the first base section and includes a second set of the plurality of rolling supports. A second section is removably secured concentrically around the first section and supported at least in part by the second set of the plurality of rollers to define a second radius greater than the first radius.

In some cases the first section includes a plurality of pieces that are removably secured to each other to create the first section. The second section may also include a plurality of pieces that are removably secured to each other to create the second section. The first one of the plurality of base sections may include a plurality of parts that are removably secured to each other to create the first one of said plurality of base sections. The second one of the plurality of base sections may also include a plurality of parts removably secured to each other to create the second one of the plurality of base sections.

In another aspect a turntable is provided and includes a hub that defines an axis. A first section has an outer edge and a center aligned with the axis, the first section is affixed to the hub. A second section has an inner edge configured to fit around the outer edge of the first section. The second section is removably secured to the first section such that the first and second sections are rotatable about the hub.

DETAILED DESCRIPTION OF THE INVENTION

Figure 1:
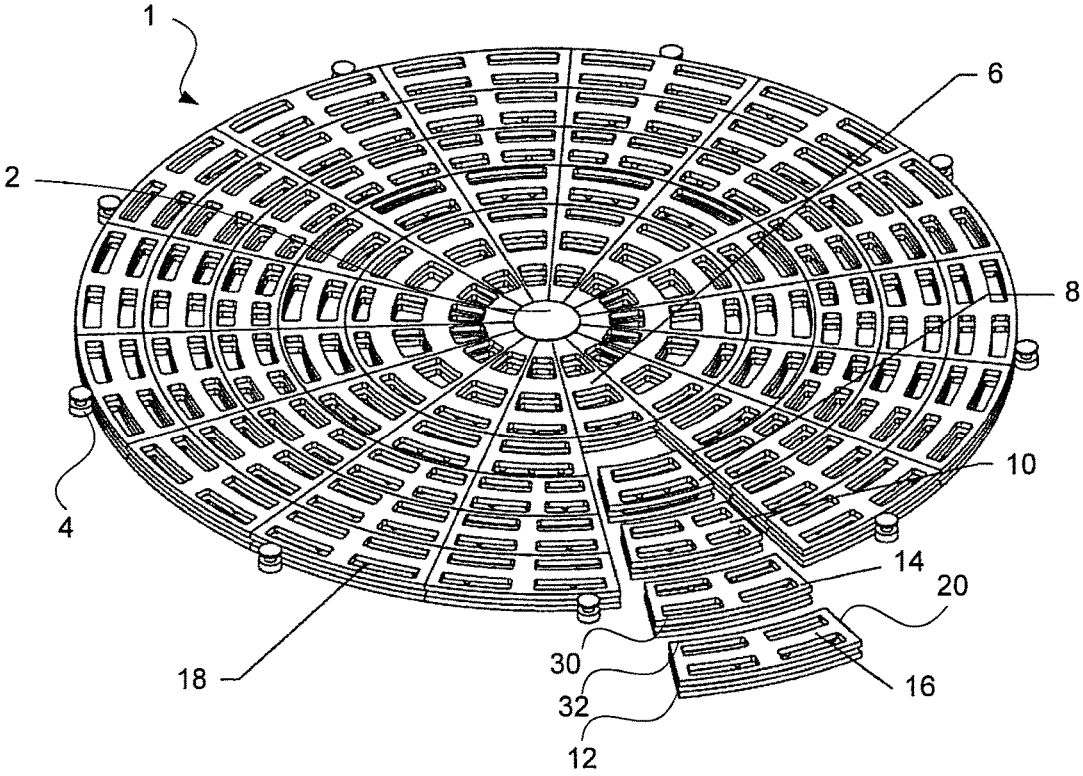
FIG. 1 is a perspective partially exploded view of a modular turntable according to the present invention.

Referring now to the drawings, wherein like reference numerals designate corresponding structure throughout the views. The following examples are presented to further illustrate and explain the present invention and should not be taken as limiting in any regard.

Figure 2:
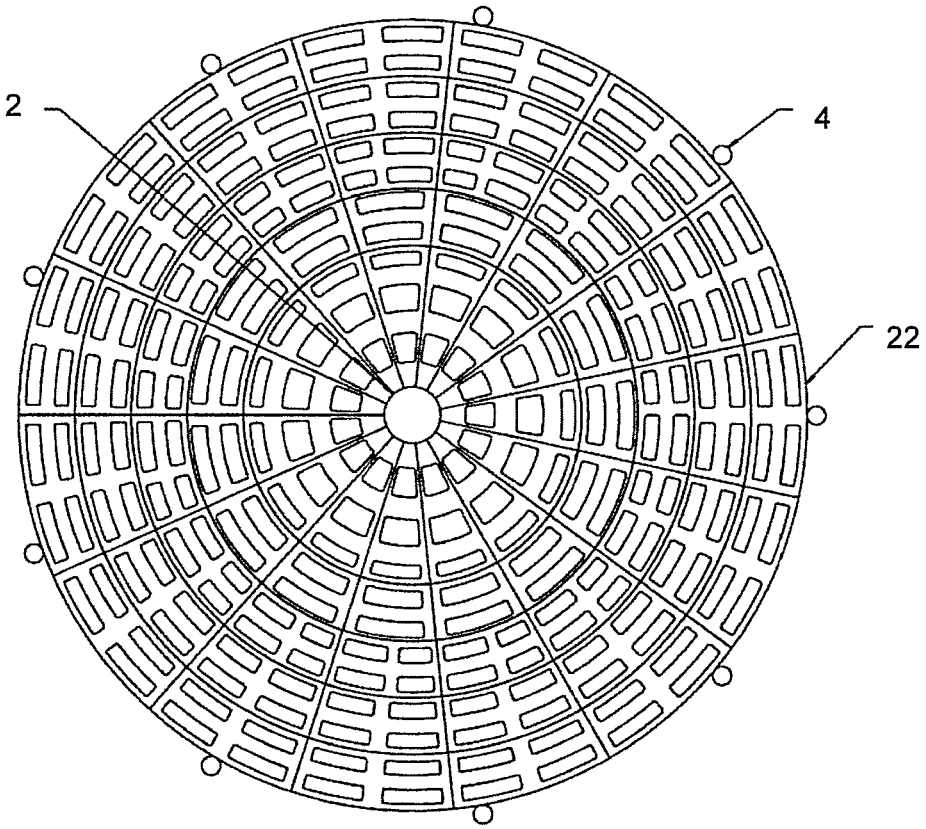
FIG. 2 is a top view of the turntable in FIG. 1
Figure 3:
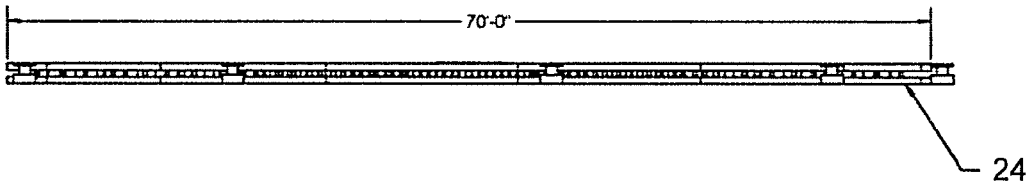
FIG. 3 is a side view of the turntable in FIG. 1
Figure 15:
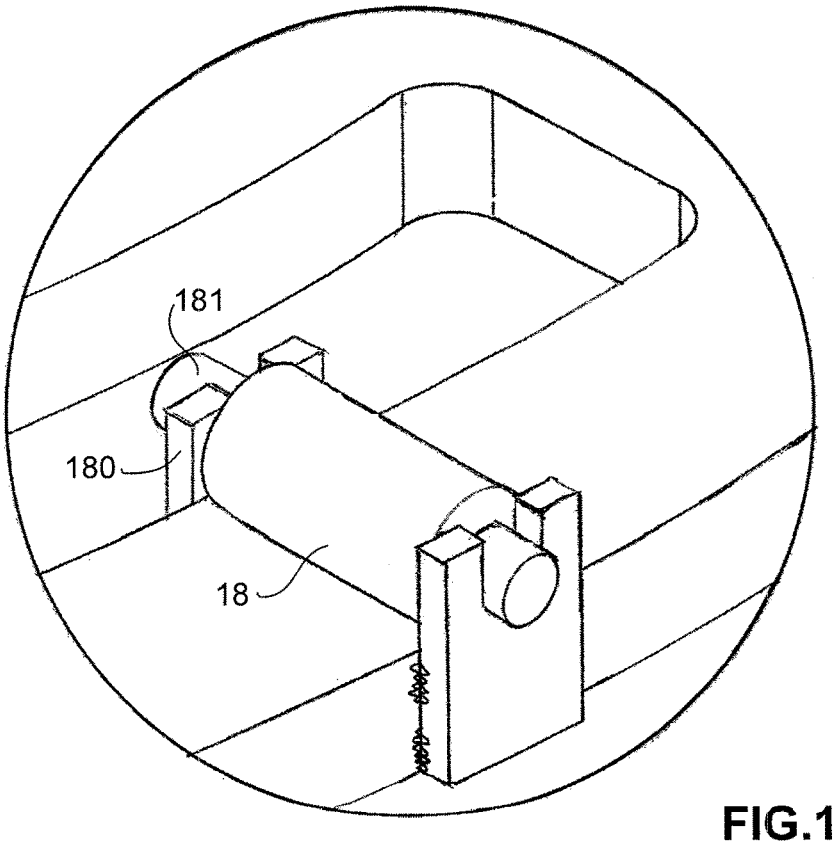
FIG. 15 is a detail view of the rollers of the turntable in FIG. 1.

In FIGS. 1-3, turntable 1 is shown partially assembled with four concentric rings having a number of modular sections. The first ring has sections that correspond to modular section 8, the second ring to modular section 10, the third ring to modular section 14 and the fourth ring to modular section 16. These rings surround center ring that is made up of modular sections that correspond to modular section 6. A hub 2 that defines the axis of rotation of the turntable (extending out of the page at the center in FIG. 2). The center ring is attached to this hub 2 so that the turntable can rotate. The modular sections (i.e. 6, 8, 10, 14, 16) all include rolling supports 18 that are sandwiched between parts of the modular sections. FIG. 15 shows one way in which the rolling supports 18 can be affixed to its respective base section. The modular sections that make up the rings include a section 20 and a base section 12 and may be generally formed in the shape of part of a pie section (two angled edges and two curved circular sections as the other edges). The base section 12 includes the rolling supports and the section 20 rolls along the rolling supports when driven by the motors 4.

Figure 12:
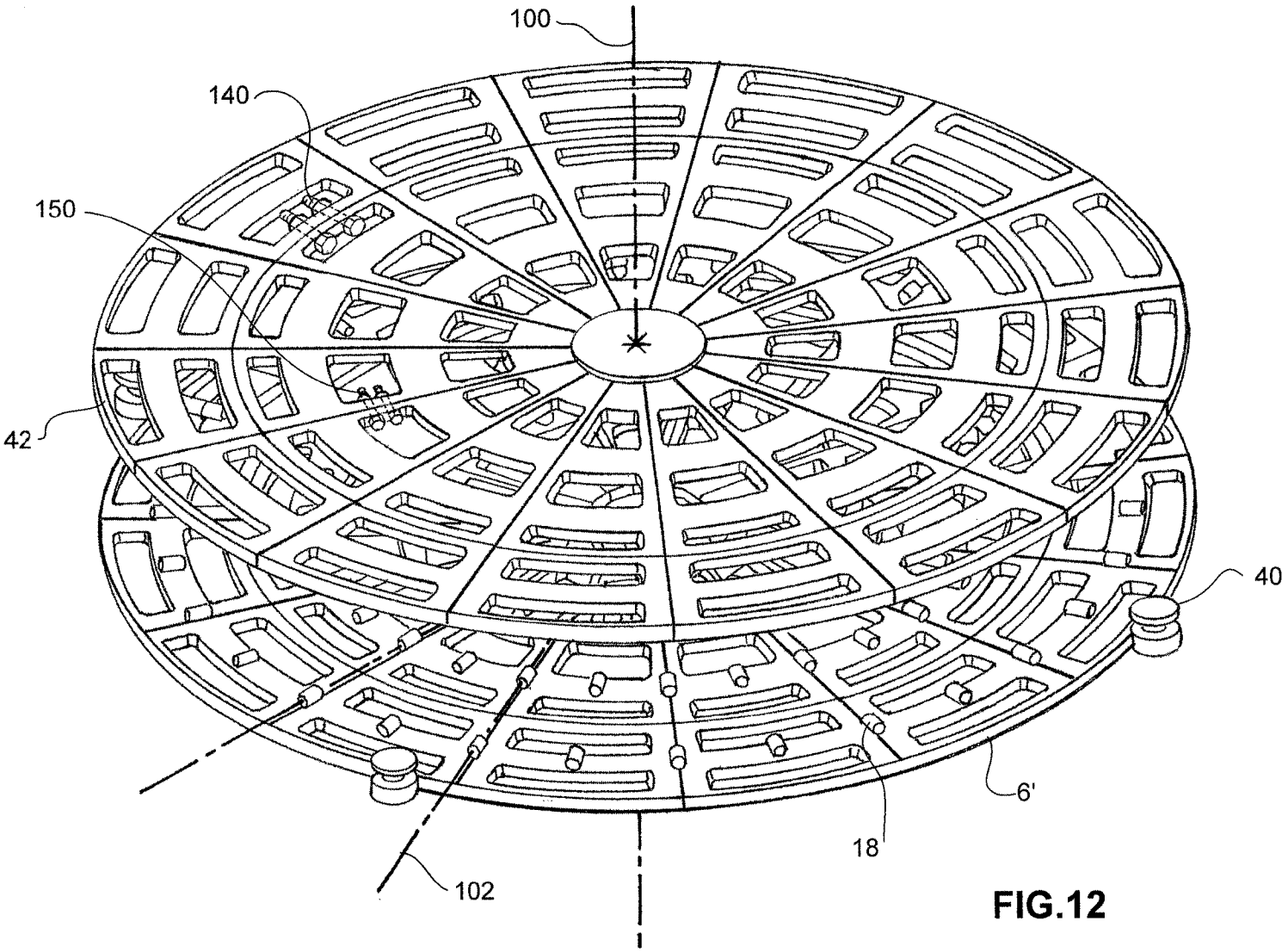
FIG. 12 is a top perspective partially exploded view of the turntable in FIG. 1 with the center section and one additional ring installed.

The base sections 12 (or parts) are preferably coupled together, for example using bolts 140/150 as shown in FIG. 12 or other securing mechanisms. In some cases the base sections are secured to the platform, foundation or flat surface that supports the turntable. For example, a ship deck. This creates the base 24 of the turntable. The sections or pieces (i.e. 20) are also coupled together to create a rotating member such that rotational forces generated by the motors 4 cause the outer sections as well as each concentric ring to rotate around the hub 2 together. It is understood that the motors 4 may be direct drive electric or hydraulic motors as but one example. It is further understood that the motors 4 may include gearboxes.

The outer edge 30 of one section cooperatively fits with the inner edge 32 of another outer section such that the rings are arranged concentrically and can attach to one another or attach to the center section, depending on the application and size of turntable required.

As can be seen in FIG. 2, motor 4 contacts the outer edge 22 to impart a rotational force on the turntable. As the diameter and load capacity grows, additional motors may be added. The contact between the motor 4 and the outer edge 22 may be friction contact or there may be a gear tooth interface in the outer edge that avoids slip between the motor and outer edge. These are just some examples of how the motor drives the turntable and it is understood that other configurations and drive mechanisms may be used.

Figure 4:
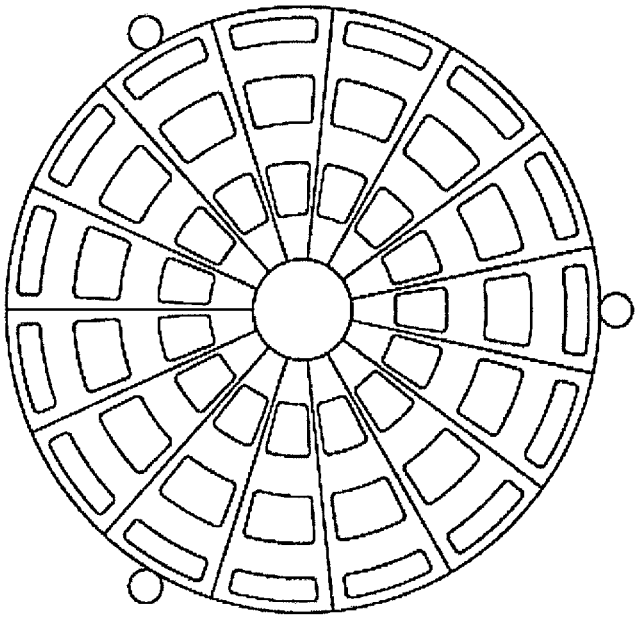
FIGS. 4 and 5 are respectively top and side views of the turntable in FIG. 1 with only the center section remaining.
Figure 5:
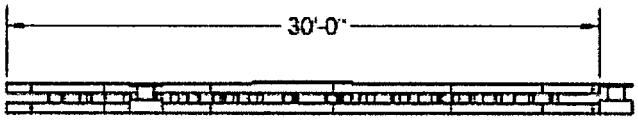

FIGS. 4 and 5 show the turntable where all outer rings have been removed and only the center modular sections are used. In this embodiment, three motors are used and the diameter of the turntable is 30 feet.

Figure 6:
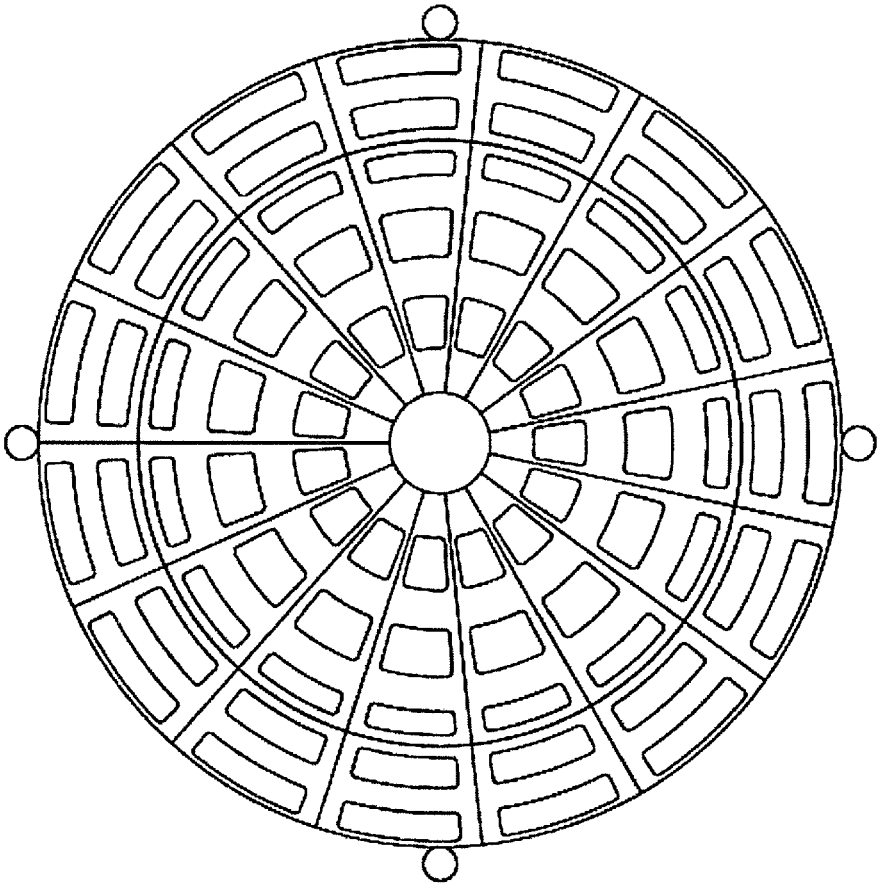
FIGS. 6 and 7 are respectively top and side views of the turntable in FIG. 1 with one additional ring around the center section.
Figure 7:
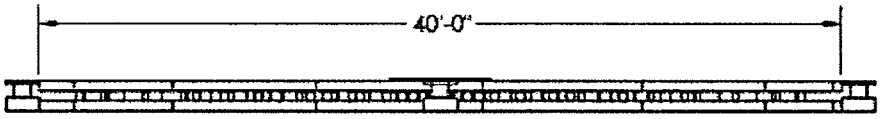

FIGS. 6 and 7 show the turntable where one outer ring is added in relation to FIGS. 4 and 5. In this embodiment, four motors are used and the diameter of the turntable is 40 feet.

Figure 8:
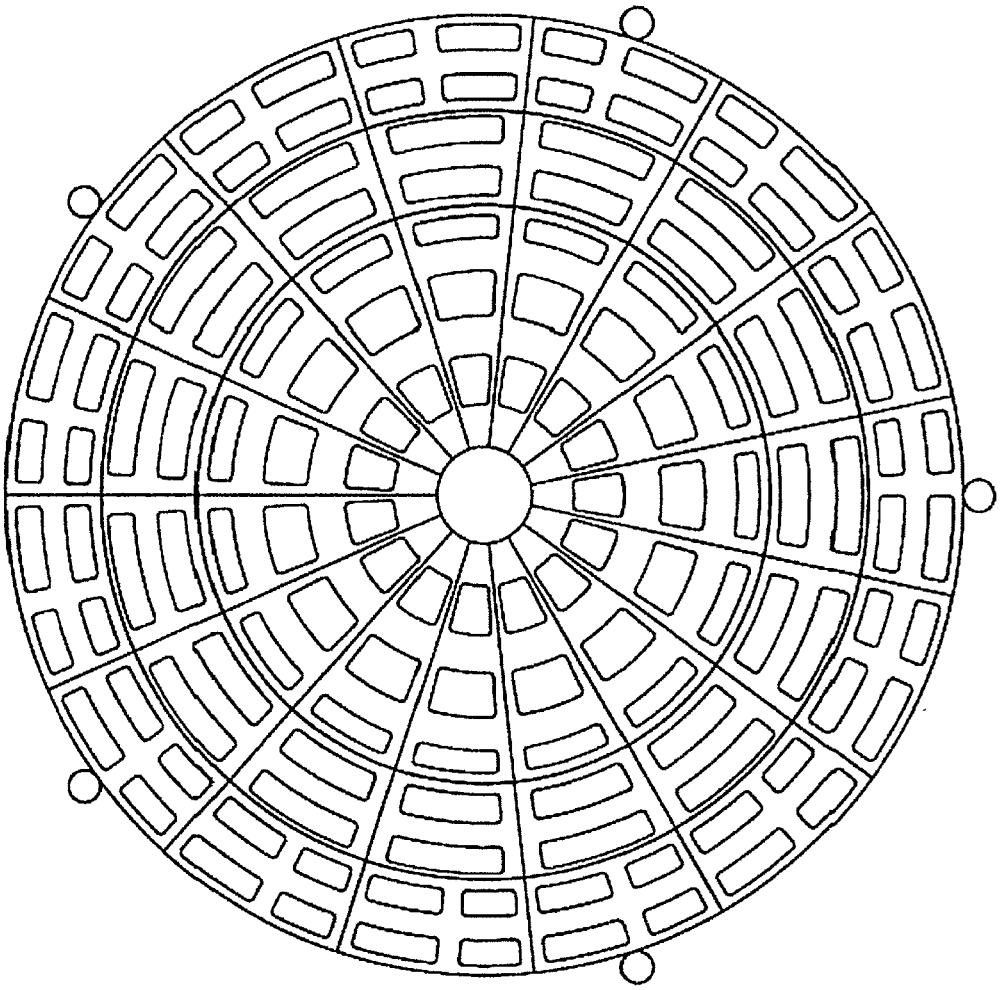
FIGS. 8 and 9 are respectively top and side views of the turntable in FIG. 1 with two additional rings around the center section.
Figure 9:
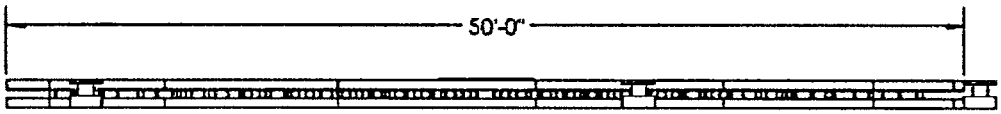

FIGS. 8 and 9 show the turntable where two outer rings are used. In this embodiment, five motors drive the turntable and the diameter of the turntable is 50 feet.

Figure 10:
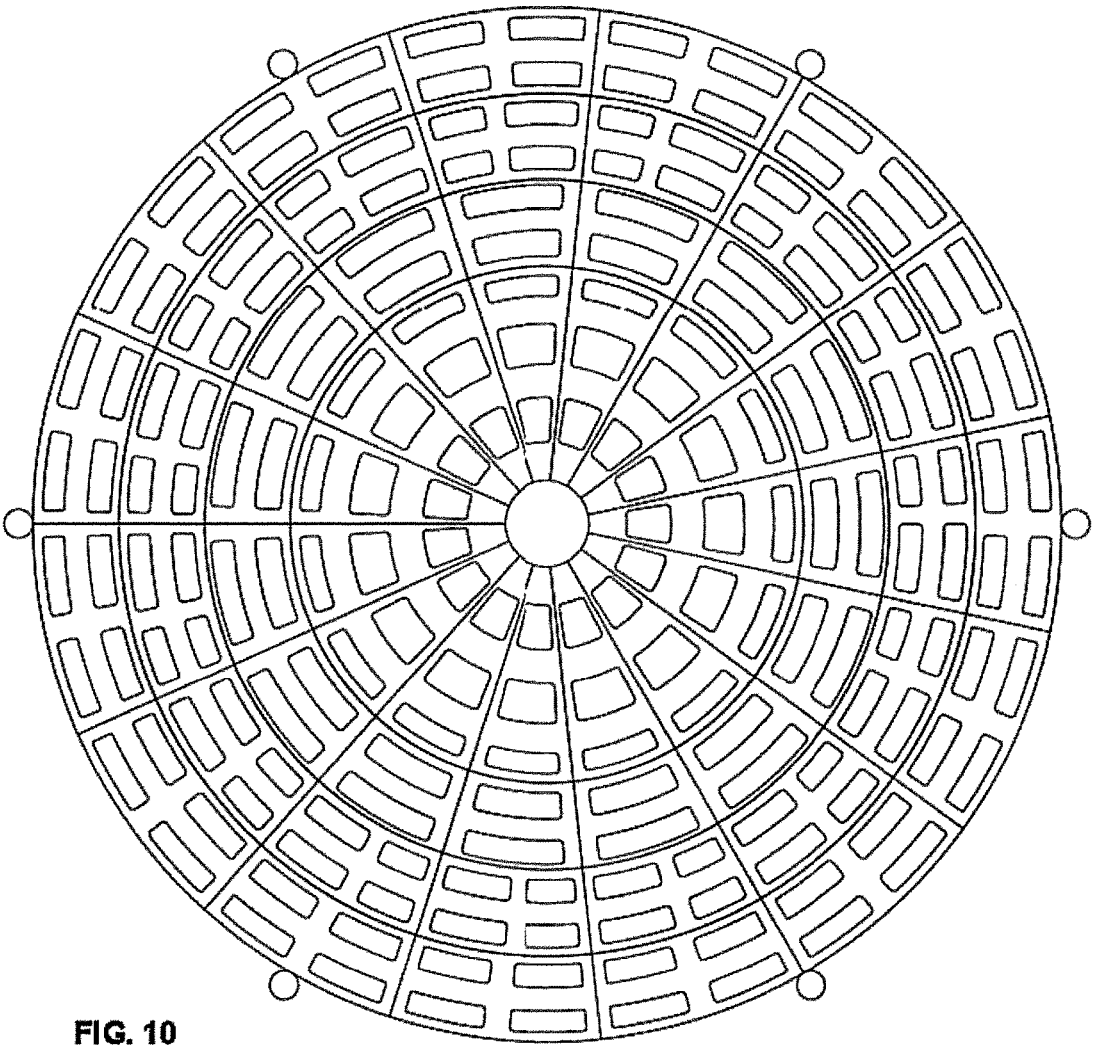
FIGS. 10 and 11 are respectively top and side views of the turntable in FIG. 1 with three additional rings around the center section.
Figure 11:
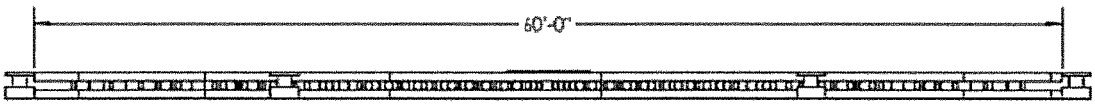

FIGS. 10 and 11 show the turntable where three outer rings are installed. In this embodiment, six motors are used and the diameter of the turntable is 60 feet.

The example turntable in FIGS. 1-3 is 70 feet in diameter.

Figure 13:
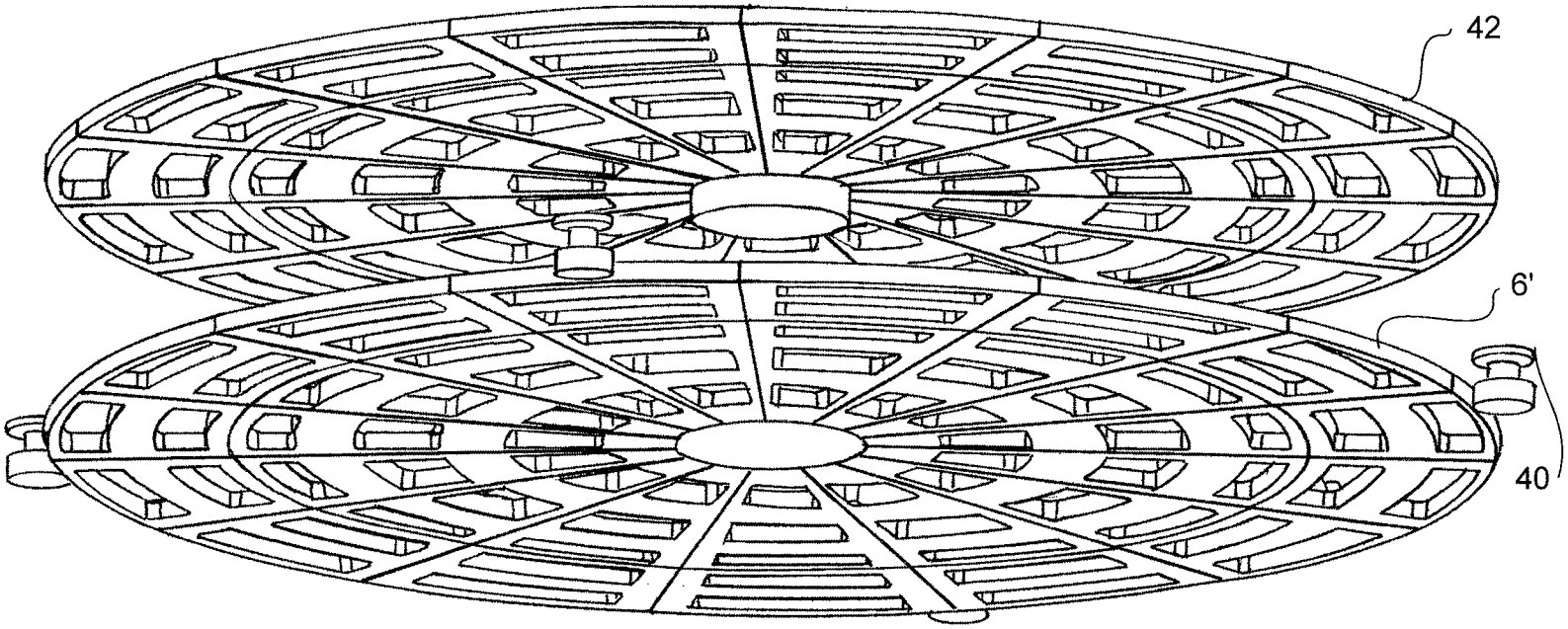
FIG. 13 is a bottom perspective partially exploded view of the turntable in FIG. 1 with the center section and one additional ring installed.
Figure 14:
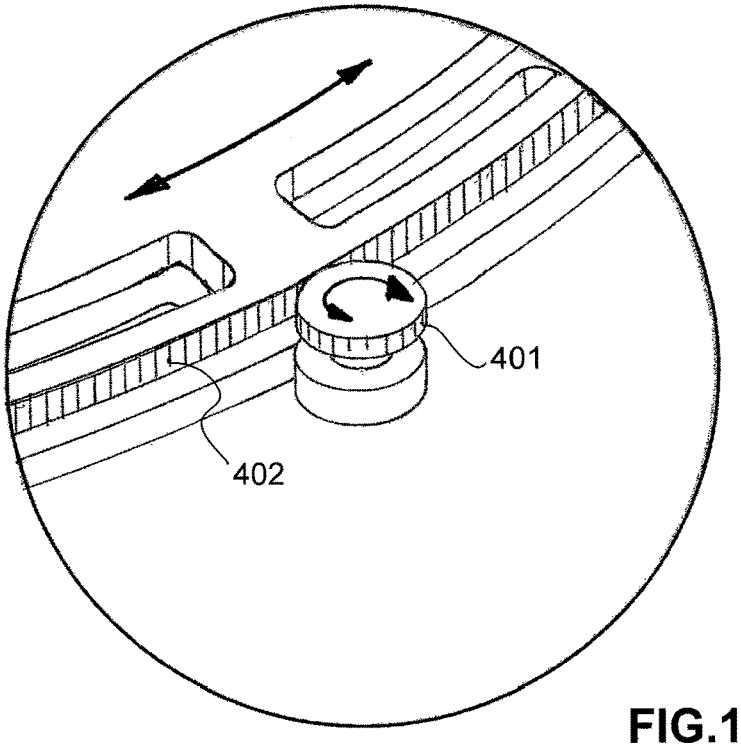
FIG. 14 is a detail view of an exemplary drive system for the turntable of FIG. 1.

Referring to FIGS. 12-14, the motor 4 may include a gear 401 that engages with teeth 402 or catches that are disposed around the outer edge of the rotating section. The motor 4 may further mount to the outer edge of the base and be releasably secured such that additional or fewer motors may be used to provide for additional power to rotate the turntable.

FIG. 15 shows an example how rollers 18 are affixed to the base section. Supports 180 may be welded to the associated base section and include a female bearing area that receives male bearing area 181. In one example male bearing area 181 includes a ball bearing that interfaces with the support 180 to enable smoother rolling of the rollers 18 during operation of the turntable. Although support 180 is shown as having an open top, it is understood that additional parts could be placed above bearing area 181 to keep the roller 18 positioned within the supports 180.

The rollers rotate about respective radial axes 102 which are perpendicular to the turntable's axis of rotation 100. The radial axis 102 intersects the axis of rotation 100.

The modular sections allow for a turntable that can be re-sized depending on the diameter required for the particular job. The 70 foot embodiment can be used on a large ship and then if a smaller ship is needed for another job, the 30 foot turntable can be assembled on that ship using the center parts of the 70 foot embodiment. This allows for one turntable (and its modular parts) that can be assembled and dis-assembled in many different configurations that are appropriate for the particular job. In addition, replacement parts can be easily made because only the modular section in need of repairs would be out of commission and spare parts modular sections can be interchanged while others are brought in for service.

The modular sections can also be cross compatible with different center sections. For example, two ships may each have the center assembly with hub installed thereon and depending on the job requirements, the 30 foot turntable may work for one ship whereas the other can take on additional rings to size the turntable for the given job.

As can be seen, many of the parts that make up the turntable are made of flat plates. This allows the parts to be cut on a two dimensional cutting machine, for example a waterjet, plasma, laser or other two dimensional cutter. As can also be seen, parts of the turntable include holes therein. These holes reduce the overall weight of the individual parts. In some applications, the holes would not be used to provide for additional rigidity. As can also be seen in FIG. 12, there are numerous rolling supports 18 positioned between the bases and rotating sections of the turntable. In one aspect, the load capacity of the turntable may be increased by providing additional rolling supports.

Also contemplated herein is a method of assembling the disclosed turntable. This method includes the steps of assembling the turntable base from a plurality of pieces by securing the pieces to a base structure such as a foundation, a ship deck or by placing the pieces on a flat surface. The pieces are assembled around a center such that rollers are positioned on the pieces. The rotating section is assembled on top of the assembled base, preferably with the center being connected so that it rotates around the hub and next pieces of the rotating section are connected to the center in concentric rings such that the pieces of the rotating section contact.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A turntable comprising:

a hub defining a first rotation axis;

a base including a plurality of rolling supports that each rotate about one of a plurality of axes of rotation perpendicular to said first rotation axis, said base including a plurality of base sections;

a rotating member secured to said hub such that a center of said rotating member aligns with the first rotation axis, said rotating member including a plurality of sections;

a first one of said plurality of base sections disposed radially around said hub and including a first set of the plurality of rolling supports;

a first one of said plurality of sections is coupled to the hub that defines a center of said rotating member, said first one of said plurality of sections supported by the first set of the plurality of rolling supports and defining a first radius;

a second one of said plurality of base sections removably secured radially outwards of said first base section and including a second set of the plurality of rolling supports; and a second section removably secured around said first section and supported at least in part by said second set of the plurality of rollers to define a second radius greater than the first radius.

2. The turntable of claim 1 wherein the first section includes a plurality of pieces that are removably secured to each other to create the first section.

3. The turntable of claim 1 wherein the second section includes a plurality of pieces that are removably secured to each other to create the second section.

4. The turntable of claim 1 wherein the first one of said plurality of base sections includes a plurality of parts that are removably secured to each other to create the first one of said plurality of base sections.

5. The turntable of claim 1 wherein the second one of said plurality of base sections includes a plurality of parts removably secured to each other to create the second one of said plurality of base sections.

6. A turntable comprising:

a hub defining an axis;

a first section having an outer edge and a center aligned with the axis, said first section affixed to said hub; and a second section having an inner edge, the inner edge configured to fit around the outer edge of said first section, said second section removably secured to said first section such that said first and second sections are rotatable about said axis;

wherein a first set of a plurality of pieces corresponds to said first section and a second set of said plurality of pieces corresponds to said second section and the second set of said plurality of pieces is configured as a concentric ring around said first set of said plurality of pieces when said first and second sets of said plurality of pieces are assembled;

wherein said second section is configured to be arranged concentrically around said first section, and further comprising rollers positioned below a bottom surface of said first and second sections, said rollers supporting said first and second sections to enable rotation about said axis.

7. The turntable of claim 6 further comprising a base having said rollers secured thereto.

8. The turntable of claim 7 wherein said base is comprised of a plurality of pieces, each including a plurality of rollers secured thereto.

9. The turntable of claim 6 wherein the first set of said plurality of pieces has a center which aligns with the axis.

10. A kit for a modular turntable comprising:

a hub defining an axis of rotation;

a plurality of pieces;

a first set of said plurality of pieces corresponding to a first rotatable section which is configured to have its center aligned with said axis of rotation;

a second set of said plurality of pieces corresponding to a second rotatable section which is configured to secure to said first rotatable section around an outer edge of said first rotatable section;

a third set of said plurality of pieces corresponding to a first base section which is configured to have its center aligned with said axis of rotation;

a fourth set of said plurality of pieces corresponding to a second base section configured to be positioned radially outwards of said first base section;

a plurality of rollers configured to be positioned between said first and second base sections and said first and second rotatable sections such that the first and second rotatable sections are supported by said plurality of rollers to enable rotation;

wherein the plurality of rollers are coupled to one of the pieces in said third or fourth set of said plurality of pieces.

11. The kit of claim 10 further comprising a motor configured to drive said first and second rotatable sections to rotate about said axis of rotation.

12. The kit of claim 11 wherein said motor is configured to drive said first and second rotatable sections at an outer edge of said second rotatable section.

13. The kit of claim 10 further comprising a plurality of motors.

14. The kit of claim 13 wherein said motors each include a gearbox.

15. A kit for a modular turntable comprising:

a hub defining an axis of rotation;

a plurality of pieces;

a first set of said plurality of pieces corresponding to a first rotatable section which is configured to have its center aligned with said axis of rotation;

a second set of said plurality of pieces corresponding to a second rotatable section which is configured to secure to said first rotatable section around an outer edge of said first rotatable section;

a third set of said plurality of pieces corresponding to a first base section which is configured to have its center aligned with said axis of rotation, said first base section having a plurality of rollers secured thereto;

wherein when the first and second sets of said plurality of pieces are assembled with the hub to form an assembly, the assembly is configured to rotate about the axis of rotation.

16. The kit of claim 15 wherein the plurality of rollers are configured to be positioned between said first base section and said first and second rotatable sections such that the first and second rotatable sections are supported by said plurality of rollers to enable rotation.

17. The kit of claim 15 further comprising a motor configured to drive said assembly about said axis of rotation.

18. The kit of claim 17 wherein said motor is configured to drive said assembly at an outer edge thereof.

19. The kit of claim 15 further comprising a plurality of motors.

20. The kit of claim 19 wherein said motors each include a gearbox.

21. The kit of claim 18 wherein said motor includes a plurality of separate motors.

22. The kit of claim 21 wherein each said plurality of separate motors includes a gearbox.

23. The kit of claim 15 wherein at least one of said first, second or third sets of said plurality of pieces when assembled is configured with a circular outer edge.

* * * * *